US005790930A

United States Patent [19]

Fuchiwaki

[11] Patent Number: 5,790,930

[45] Date of Patent: Aug. 4, 1998

[54] IMAGE FORMING METHOD AND APPARATUS THEREFOR

[75] Inventor: Takashi Fuchiwaki, Ebina, Japan

[73] Assignee: Fuji Xerox Co., Ltd., Tokyo, Japan

[21] Appl. No.: 800,392

[22] Filed: Feb. 14, 1997

[30] Foreign Application Priority Data

Feb. 26, 1996 [JP] Japan ..... 8-065405

[51] Int. Cl.[6] ..... G03G 15/01; G03G 15/16

[52] U.S. Cl. ..... 399/302; 399/162; 399/167

[58] Field of Search ..... 399/302, 308, 399/159, 162, 167

[56] References Cited

U.S. PATENT DOCUMENTS

| | | | |
|---|---|---|---|
| 5,040,028 | 8/1991 | Kamimura et al. | 399/302 |
| 5,515,145 | 5/1996 | Sasaki et al. | 399/302 |
| 5,515,154 | 5/1996 | Hasegawa et al. | 399/167 X |
| 5,519,475 | 5/1996 | Miyamoto et al. | 399/308 |

FOREIGN PATENT DOCUMENTS

| | | |
|---|---|---|
| A-62-195687 | 8/1987 | Japan . |
| Sho-62-206567 | 9/1987 | Japan . |
| Hei-6-167842 | 6/1994 | Japan . |
| Hei-6-258897 | 9/1994 | Japan . |
| 7-160165 | 6/1995 | Japan . |
| 8-211755 | 8/1996 | Japan . |
| 8-227200 | 9/1996 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

An image forming method using an image forming apparatus, the apparatus including: a rotary image carrier, and a rotary intermediate transfer medium arranged in pressure-contact with the image carrier, wherein at least one of the image carrier or the intermediate transfer medium is a belt-shape rotary body which is looped over a group of rolls and can circulate with at least one of the rolls as a drive transmission roll, and the peripheral length of the belt-shape rotary body is m (m: integer)-times as long as the peripheral length of the drive transmission roll, the method including the steps of: a toner image forming step of rotating the image carrier at a constant peripheral speed to form the toner image successively for each color component on the image carrier; a toner image intermediate transfer step of rotating the intermediate transfer medium at a constant peripheral speed different from the constant peripheral speed of the image carrier, on condition that one revolution time of the intermediate transfer medium is n (n: integer or 1/integer)-times as long as one revolution time of the image carrier, to transfer the toner image for each color component carried on the image carrier; and a toner image final transfer step of collectively transferring the toner image for each color transferred on the intermediate transfer medium onto a recording medium.

9 Claims, 11 Drawing Sheets

IMAGE FORMING METHOD AND APPARATUS THEREFOR

BACKGROUND OF THE INVENTION

The present invention relates to an image forming apparatus such as an electrophotographic copier, and more particularly to an improvement of the image forming apparatus of the type using an intermediate transfer medium.

In an image forming apparatus such as an electrophotographic copier, several methods of transferring a toner image formed on an image carrier such as a photosensitive drum to a transfer material have been generally used in which the transfer material superposed on the toner image on the image carrier is conveyed and the transfer material is charged from its rear side to adsorb the toner image to the transfer material electrostatically.

Particularly, one of these methods is to support the transfer material once on a transfer drum rotating synchronously with the image carrier and to transfer the toner image onto the transfer material supported on the transfer drum. Such a method, which can directly transfer the toner image on the transfer material multiply, has been used for a color image forming apparatus. However, in such a color image forming apparatus using the transfer drum, it is difficult to hold a thick and firm material on a transfer drum and is possible to use only limited kinds of transfer materials.

A known example of the color image forming apparatus which should be substituted for the transfer drum system described above is disclosed in the Unexamined Japanese Patent Application Publication No. Sho 62-206567 in which the toner image on an image carrier such as a photosensitive drum is primary-transferred on an intermediate transfer medium other than the transfer material and the toner image thus transferred is secondary-transferred to the transfer material.

The color image forming apparatus performing the multiple transfer based on such an intermediate transfer system provides known effects of capable of suppressing poor multiple transfer and occurrence of displacement of color registration due to several causes inclusive of the holding state of a transfer material such as a transfer sheet, and thickness or firmness and surface property of the transfer material.

Further, the color image forming apparatus using the intermediate transfer medium can provide a color image on several kinds of transfer material inclusive of thick paper like a transfer material used in a black-and-white or monochromatic copier, and has an advantage of capable of simplifying a sheet feed mechanism because of unnecessity of holding the transfer material on the transfer drum, thereby reducing a trouble of paper jam.

Additionally, the color image forming apparatus is involved in the problem of a change in the peripheral speed of an image carrier such as a photosensitive drum or intermediate transfer medium due to eccentricity of a rotary member. The resultant contamination of color or hue gives an adverse effect on the quality of a color image.

Thus, the image forming apparatus such as a copier, laser printer provided with the image carrier such as a photosensitive drum and the intermediate is required to solve the important problem of color alignment of the toner image of each color on the intermediate transfer material to obtain a high definition color image. For this purpose, as disclosed in the Unexamined Japanese Patent Application Publication No. Sho 62-195687, there has been proposed a technique of controlling each driving means for driving the image carrier such as the photosensitive drum and intermediate transfer medium, in synchronism with a common main clock signal and controlling the light exposure and transfer of each color using the above main clock signal.

However, the conventional image forming apparatus described above, which effects electrical control, requires a large number of control components such as a sensor for detecting the speed of e.g. an encoder, a processing circuit for the signal detected by the sensor, a clock supply circuit, a reference signal generating circuit and CPU for controlling these circuits. This complicates the structure of the image forming apparatus to increase the cost.

One of previously known techniques for obviating such circumstances is a structure as disclosed in the Unexamined Japanese Patent Application Publication No. Hei 6-167842 in which the peripheral length of an intermediate transfer belt is integer-times as long as the peripheral length of a driving roll for driving it, and the peripheral length of the driving roll is inter-times as long as that of another driving roll for driving a photosensitive belt.

The above structure can make the pitch of a speed change in the intermediate transfer belt due to the eccentricity component of the driving roll synchronous with the pitch in the speed change in the photosensitive belt. But since no condition is prescribed on the peripheral lengths of the intermediate transfer belt and the photosensitive belt, the starting point of writing the image onto the photosensitive belt for each color will vary relatively with the position of the intermediate transfer belt. Therefore, even if a speed difference between the intermediate transfer medium and the photosensitive belt can be eliminate, color inconsistency due to a nonuniform potential and application (or painting) on the photosensitive belt can be removed. In addition, if the speed of the predetermined position of the photosensitive belt varies relatively with an average speed, the position of the intermediate transfer belt position corresponding to the speed changing position also varies. This gives rise to positional displacement (color displacement) of the toner image for each color component, thus making it impossible to obtain a high definition color image.

In another conventional technique as disclosed in e.g. the Unexamined Japanese Patent Application Publication No. Hei 6-258897, with an intermediate transfer drum supported to rotate in contact with a photosensitive belt, the rotary speed of a motor for driving a photosensitive belt is controlled by a control device so that the one rotational period of the intermediate transfer drum is a predetermined period, and data for controlling the speed of a motor for driving the photosensitive belt is adjusted separately from the timing of forming an electrostatic latent image. In this way, according to the technique disclosed in the Unexamined Japanese Patent Application Publication No. Hei 6-258897, without generating the speed difference between the photosensitive belt and the intermediate transfer drum, plural toner images are superposed for transfer on the surface of the intermediate transfer drum.

However, this technique is involved in a new technical problem that toners in the uppermost layer of the color toner images transferred multiply on the intermediate transfer medium are apt to fall out.

Presumably, this is due to the fact that the applying force between the photosensitive belt and toners and the flocculation force among the toners are larger than because the peripheral speed of the photosensitive belt and the intermediate transfer drum are controlled to be equal to each other to superpose toner images on one another. It has been experimentally confirmed by the inventors of the present invention that the shearing force due to a speed difference other than the electrostatic physical pressure applied on the toner layer contributes to difficulty of fall-out of the toners on the uppermost layer.

SUMMARY OF THE INVENTION

The present invention has been accomplished to solve the technical problem described above.

The present invention intends to provide an image forming apparatus having a simple structure which can efficiently suppress color displacement due to color inconsistency attendant on the positional inconsistency of the toner image for each color or color inconsistency due to non-uniform charging of an image carrier and efficiently avoid deterioration in image quality due to fall-out of toners in the uppermost layer so as to provide a color image with good quality.

As shown in FIG. 1, in an image forming apparatus including a rotary image carrier 1 and a rotary intermediate transfer medium arranged in pressure-contact with the image carrier 1, the present invention is characterized by comprising a toner image forming step D of rotating the image carrier 1 at a constant peripheral speed Vp to form the toner image successively for each color component on the image carrier 1, a toner image intermediate transfer step E of rotating the intermediate transfer medium 2 at a constant peripheral speed Vm different from that of the image carrier 1, on condition that the one revolution time tm of the intermediate transfer medium 2 is n (n: integer or 1/integer) -times as long as one revolution time tp of the image carrier 1, to transfer the toner image for each color component carried on the image carrier 1, and a toner image final transfer step C of collectively transferring the toner image for each color transferred on the intermediate transfer medium 2 onto a recording medium 6.

In an image forming apparatus including a rotary image carrier 1, an intermediate transfer medium 2 in pressure-contact with the image carrier 1, a multi-color toner image forming means 3 for successively forming the toner image for each color by a predetermined image forming process on the image carrier 1, a primary transfer means 4 for successively transferring the toner image for each color carried on the image carrier 1 to the intermediate transfer medium 2, and a secondary transfer means 5 for collectively transferring the toner image for each color multiply transferred on the intermediate transfer medium 2, the apparatus according to the present invention for embodying the method described above, as shown in FIG. 2 is characterized by comprising an image carrier driving means 8 for driving the image carrier 1 at a constant peripheral speed Vp and an intermediate transfer medium driving means 9 for driving the intermediate transfer medium 2 at a constant peripheral speed Vm different from that of the image carrier 1 so as to satisfy the condition that the one revolution time tm of the intermediate transfer medium 2 is n (n: integer or 1/integer)-times as long as one revolution time tp of the image carrier 1.

In such a method and apparatus, the peripheral speed vp of the image carrier 1 and that Vm of the intermediate transfer medium 2 may be different. The one may not necessarily be higher than the other, and the speed difference therebetween may not be also determined uniquely.

Specifically, the speeds Vp and Vm should be selected suitably so that the toner image of the uppermost layer does not fall out considering the conditions of pressure-contact between the image carrier 1 and the intermediate transfer medium 2 (pressure-contact force and surface-contact state (surface roughness and frictional resistance), etc.), primary transfer, etc.

When at least one of the image carrier 1 and intermediate transfer medium 2 is a belt-shape rotary body BT which is looped over a group of rolls 7 and can circulate with at least one of the rolls 7 as a drive transmission roll 7a, the peripheral length Lb of the belt-shape rotary body BT is preferably m-times as long as the peripheral length Lbr of the drive transmission roll 7a.

In changing the drive transmission roll 7a into a new drive transmission roll having a different peripheral length, Lb of the belt-shape BT must be adjusted correspondingly.

In an image forming apparatus in which one of the image carrier 1 and intermediate transfer medium 2 is a drum-shape rotary body DM and the other is a belt-shape rotary body BT which is looped over a group of rolls 7 and can circulate with at least one of the rolls 7 as a drive transmission roll 7a, as shown in FIG. 3, the present invention comprises an image carrier driving means 8 for driving the image carrier 1 at a constant peripheral speed Vp and an intermediate transfer medium driving means 9 for driving the intermediate transfer medium 2 at a constant peripheral speed Vm different from that of the image carrier 1 on the condition that the peripheral length of the belt-shape rotary body BT is set so as to satisfy the following relationship equation:

$$Lb=m\cdot Lbr \text{ (m: integer)}$$

$$Lb/vb=n\cdot Ld/vd \text{ (n=integer or 1/integer)}$$

where

Lb: peripheral length of the belt-shape rotary body BT

Lbr: peripheral length of the drive transmission roll 7a

Ld: peripheral length of the drum-shape rotary body DM vb: peripheral speed of the belt-shape rotary body BT (Vp or Vm)

vd: peripheral speed of the drum shape rotary body DM (Vm or Vp)

In an image forming apparatus in which both of the image carrier 1 and intermediate transfer medium 2 are belt-shape rotary bodies BT each of which is looped over a group of rolls 7 and can circulate with at least one of the rolls 7 as a drive transmission roll 7a, as shown in FIG. 3, the present invention comprises an image carrier driving means 8 for driving the image carrier 1 at a constant peripheral speed Vp and an intermediate transfer medium driving means 9 for rotatively driving the intermediate transfer medium 2 at a constant peripheral speed Vm different from that of the image carrier 1 on the condition that the peripheral length of the belt-shape rotary body BT of each of the image carrier 1 and intermediate transfer medium 2 is set so as to satisfy the following relationship equation:

$$Lb1=m1\cdot Lbr1 \text{ (m1: integer)}$$

$$Lb2=m2\cdot Lbr2 \text{ (m2: integer)}$$

$$Lb1/vb1=n\cdot Lb2/vb2 \text{ (n=integer or 1/integer)}$$

where

Lb1: peripheral length of the belt-shape rotary body BT of the image carrier 1

Lbr1: peripheral length of the drive transmission roll 7a of the image carrier 1

Lb2: peripheral length of the belt-shape rotary body BT of the intermediate transfer medium 2

Lbr2: peripheral length of the drive transmission roll 7*a* of the intermediate transfer medium 2 vb1: peripheral speed of the belt-shape rotary body BT (=Vp) of the image carrier 1 vb2: peripheral speed of the belt-shape rotary body BT (=Vm) of the intermediate transfer medium 2

Further, in an apparatus according to the present invention, from the point of view of driving the belt shape rotary body BT more stably, the drive transmission roll 7*a* may have a larger contact area with the belt-shape rotary body BT than those of the other rolls 7, or it may be located at a position where there is a large change in the load for the belt-shape rotary body BT (for example, a retractable cleaner is arranged).

The image carrier driving means 8 and intermediate transfer medium driving means 9 may have individual driving sources, or may commonly use the same driving source.

Furthermore, the intermediate transfer medium driving means 9 may rotate the intermediate transfer medium at a constant peripheral speed. But, in order to improve the fixing property, for example, after the primary transfer step of transferring the toner image of a final color from the image carrier 1 to the intermediate transfer medium 2 has been completed, the peripheral speed of the intermediate transfer medium 2 may be varied.

In order to solve the technical problem of deterioration of image quality due to fall-out of toners on the upper most layer, in an image forming apparatus including a rotary image carrier 1 and a rotary intermediate transfer medium arranged in pressure-contact with the image carrier 1, the present invention may comprise a toner image forming step D of rotating the image carrier 1 at a constant peripheral speed Vp to form the toner image successively for each color component on the image carrier 1, a toner image intermediate transfer step E of rotating the intermediate transfer medium 2 at a constant peripheral speed Vm different from that of the image carrier 1 and a toner image final transfer step C of collectively transferring the toner image for each color transferred on the intermediate transfer medium 2 to a recording medium 6.

An explanation will be given of the operation of the technical means described above.

In an image forming apparatus shown in FIG. 2, first, the toner image forming step D is carried out for rotating the image carrier 1 at a constant peripheral speed Vp to form the toner image successively for each color component on the image carrier 1.

Next, the toner image intermediate transfer step E is carried out for rotating the intermediate transfer medium 2 at a constant peripheral speed Vm different from that of the image carrier 1 so that the primary transfer means 4 successively transfers the toner image for each color on the image carrier 1 to the intermediate transfer medium 2.

In this case, since the peripheral speeds of the intermediate transfer medium 2 and the image carrier 1 are different from each other, the shearing force due to a speed difference other than the electrostatic physical pressure applied on the toner layer exerts an influence on the application force between the photosensitive belt and toners and flocculation force among the toners. For this reason, in the primary transfer, because of high pile height of the toners, fall-out of the toner image on the uppermost layer does not occur.

In the toner image intermediate transfer step B, since the one revolution time tm of the intermediate transfer medium 2 is n (n: integer or 1/integer)-times as long as one revolution time tp of the image carrier 1, to transfer the toner image for each color component carried on the image carrier 1, a predetermined position of the image carrier 1 is always located to correspond to a predetermined position of the intermediate transfer medium 2. For this reason, even if the speed of the predetermined position of the image carrier 1 is varied relatively to the average speed, the position of the intermediate transfer medium 2 corresponding to the speed varying position is always fixed so that positional displacement (color displacement) of the toner image for each color due to non-uniform rotation and speed does not occur.

Thereafter, the toner image final transfer step C is carried out for collectively transferring the toner image for each color transferred on the intermediate transfer medium 2 to a recording medium 6.

When at least of the image carrier 1 and intermediate transfer medium 2 is a belt-shape rotary body BT which is looped over a group of rolls 7 and can circulate with at least one of the rolls 7 as a drive transmission roll 7*a*, the peripheral length Lb of the belt-shape rotary body BT is preferably m (m: integer)-times as long as the peripheral length Lbr of the drive transmission roll 7*a*. For this reason, the eccentric error of the drive transmission roll 7*a* appears periodically at a specific position of the belt-shape rotary body BT.

DETAILED DESCRIPTION OF THE PREFERRED EMBODIMENTS (Embodiment 1)

Figure 1:
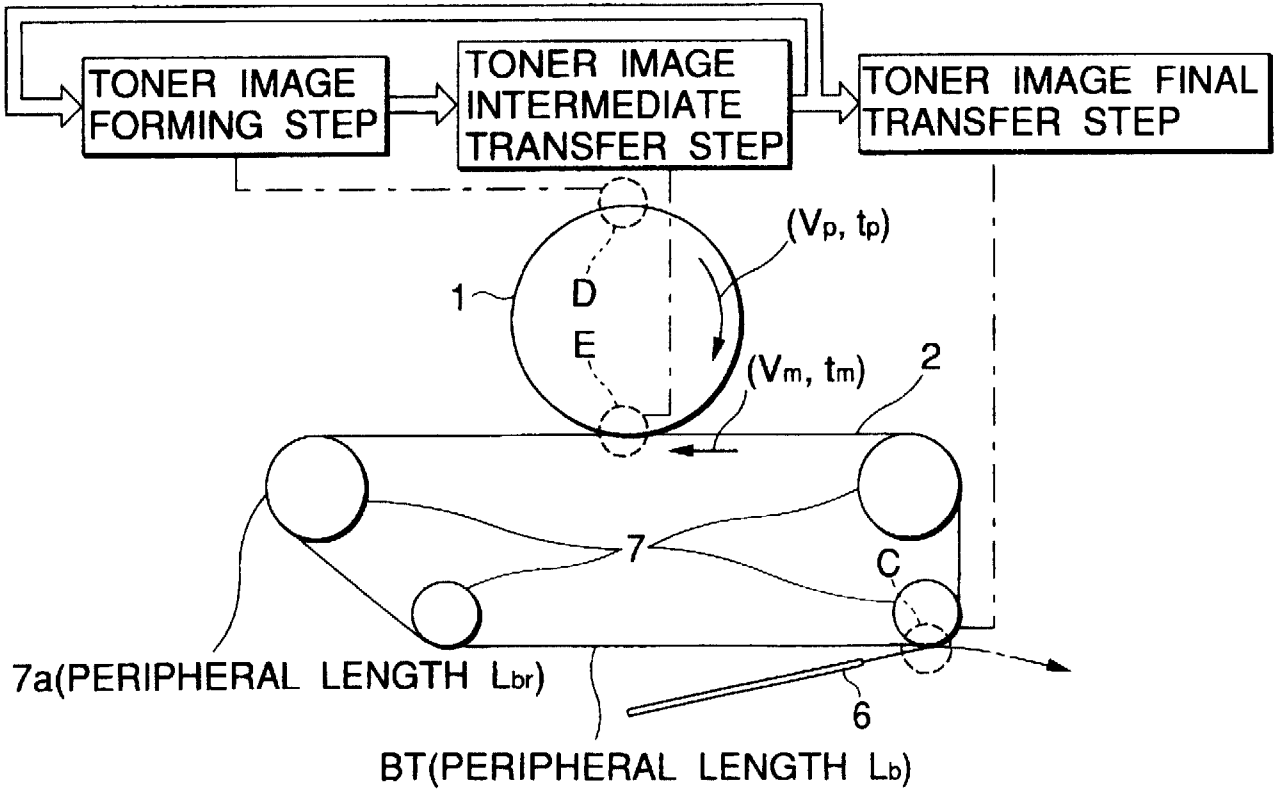
FIG. 1 is a view showing the image forming method according to the present invention.
Figure 2:
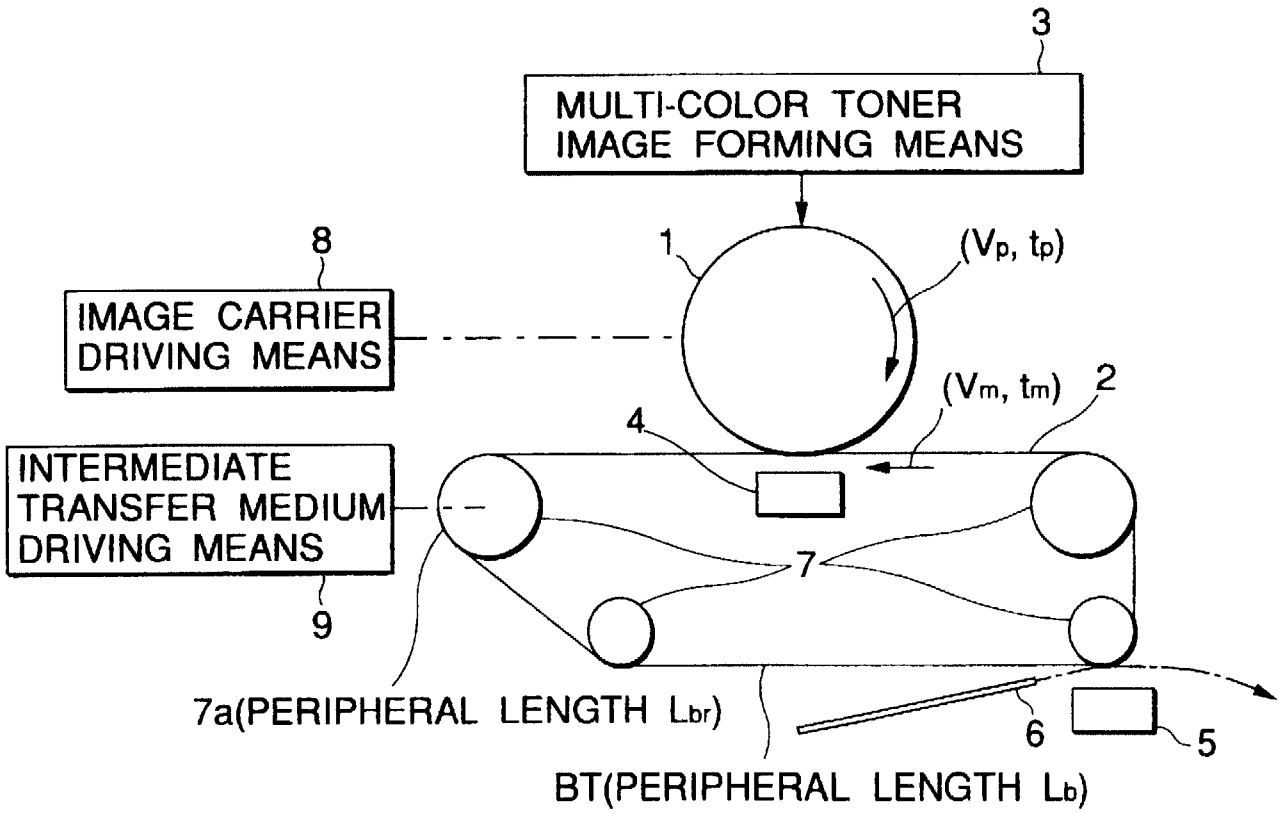
FIG. 2 is a view showing the image forming apparatus according to t resent invention.
Figure 3:
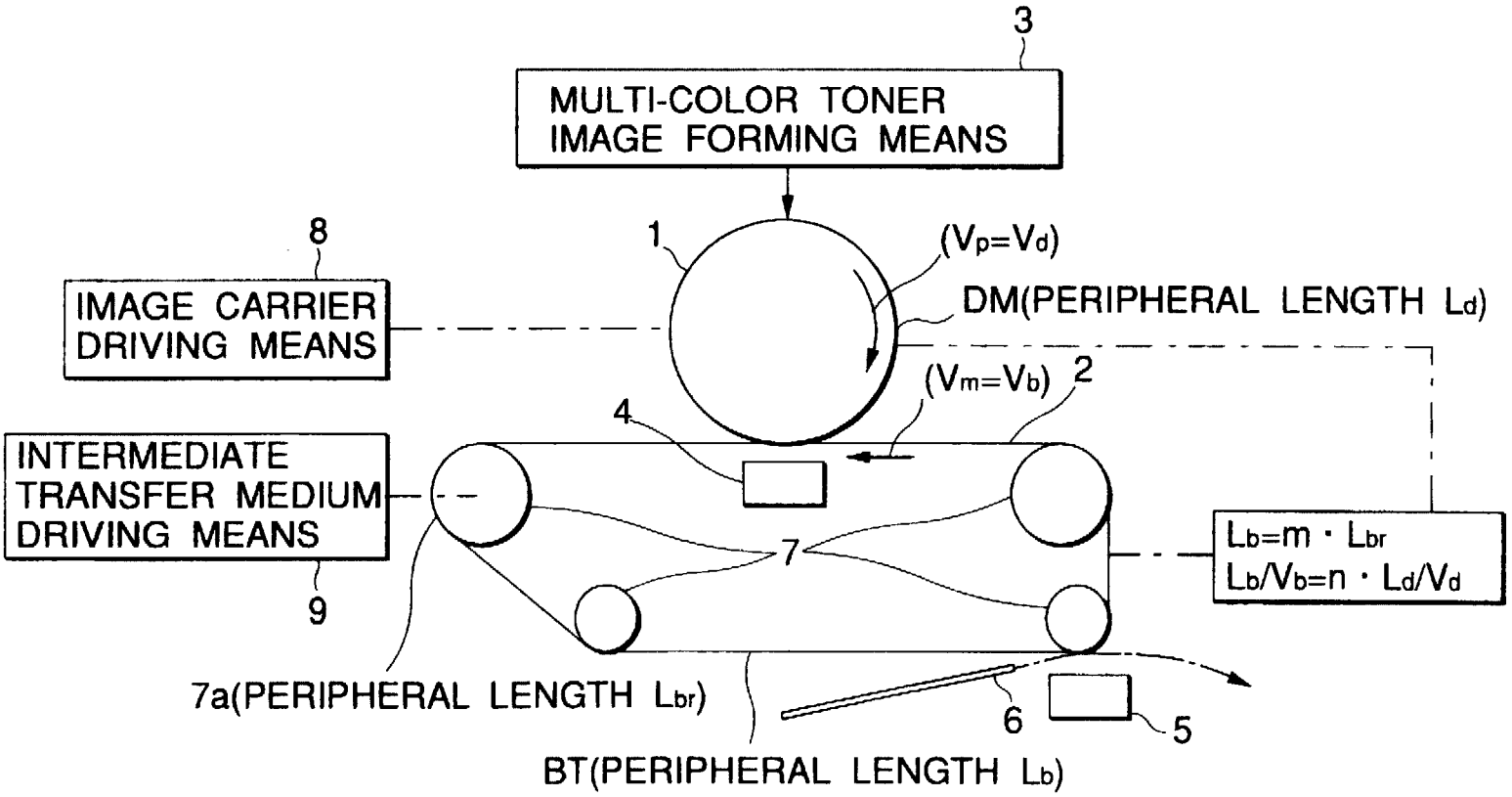
FIG. 3 is a view showing a structure of the image forming apparatus according to the present invention in which one of an image carrier and an intermediate transfer medium is a drum-shape rotary body and another thereof is a belt-shape rotary body.
Figure 4:
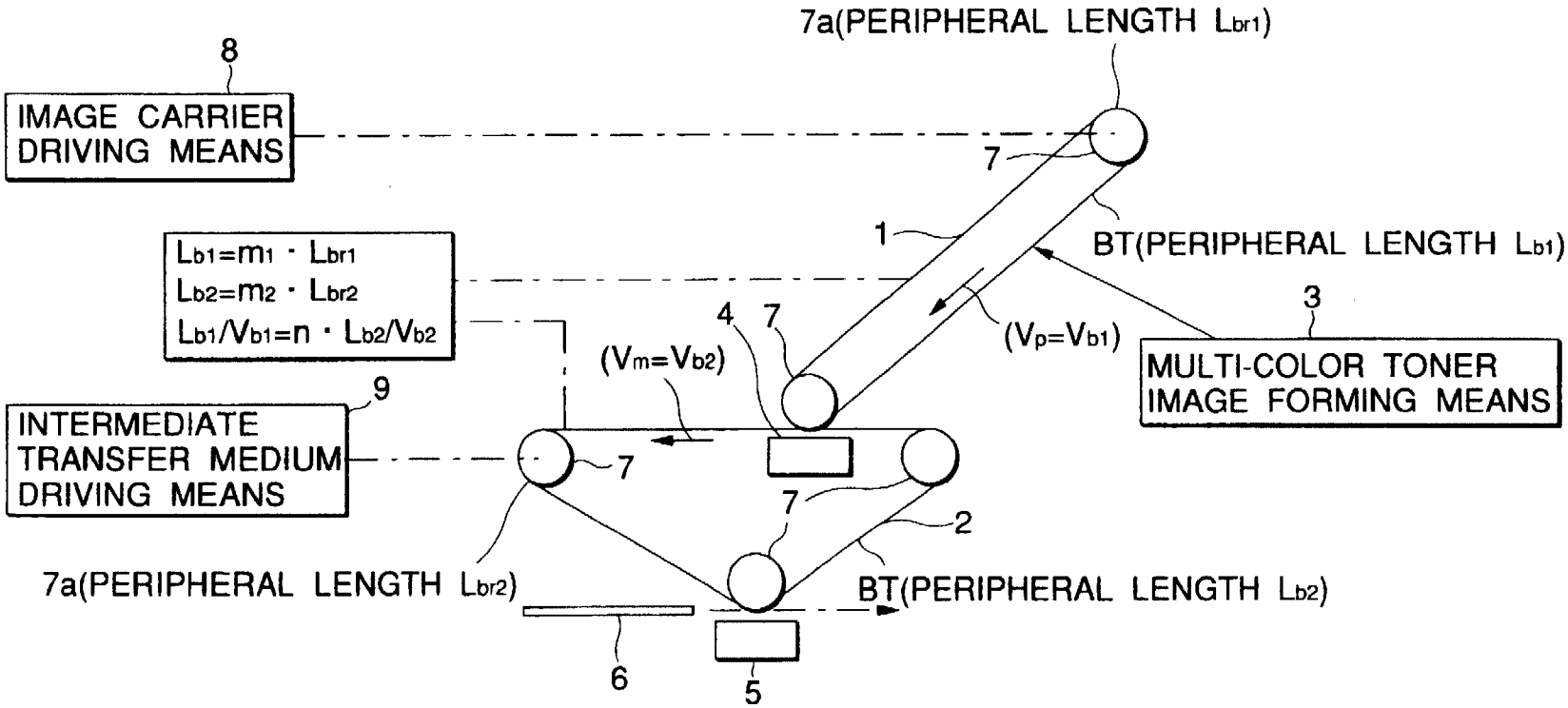
FIG. 4 is a view showing another structure of the image forming apparatus according to the present invention in which both of the image carrier and the intermediate transfer medium are belt-shape rotary bodies.
Figure 5:
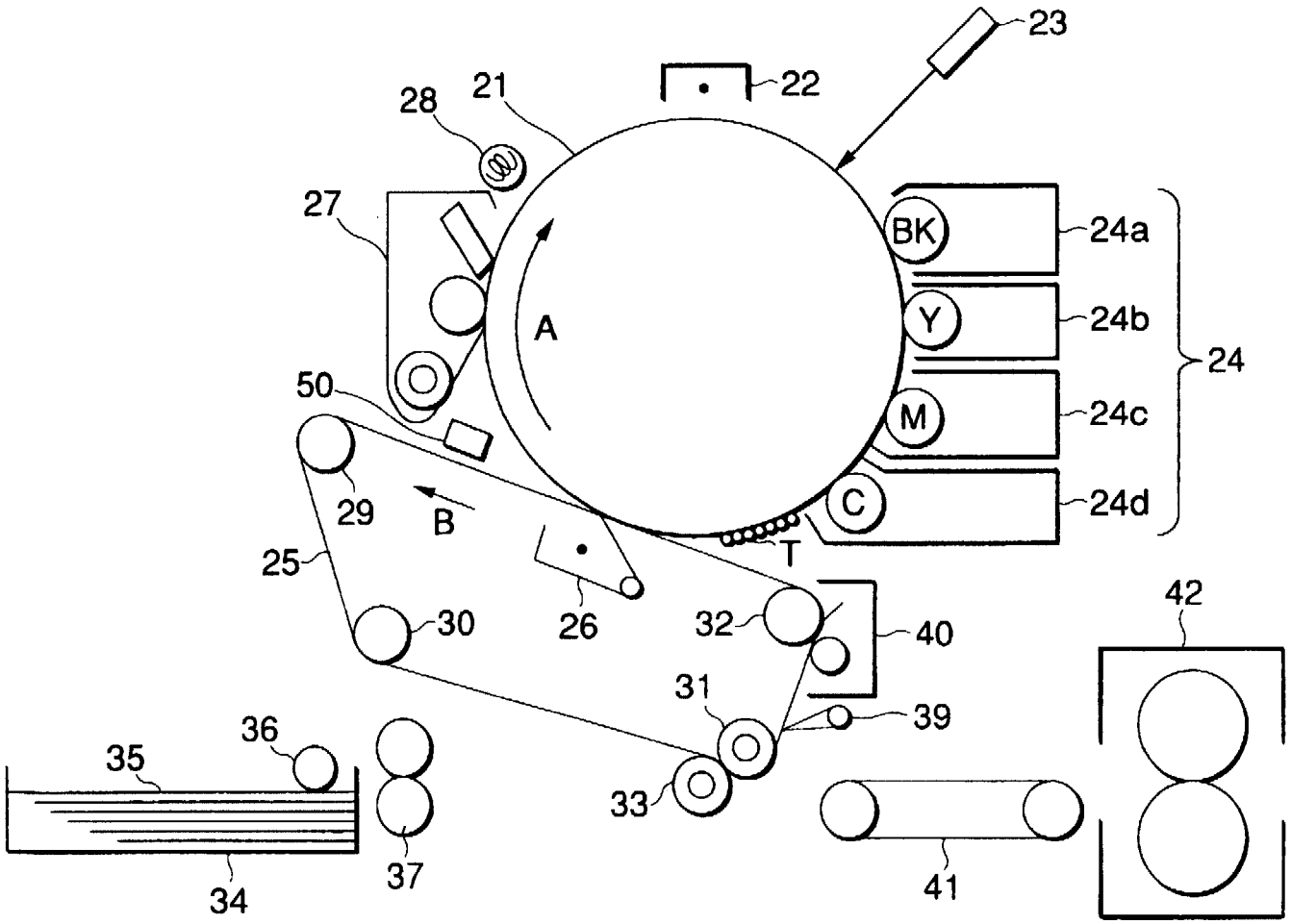
FIG. 5 is a view showing the image forming device according to the first embodiment of the present invention.

FIG. 5 is a schematic diagram of the first embodiment of the color electrophotographic copier according to the present invention. In FIG. 5, reference numeral 21 denotes a photosensitive drum with a negative polarity (OPC-1R) rotating in a direction of arrow A; 22 a uniform charger for previously charging the photosensitive drum 21; 23 a laser exposure device for writing an electrostatic latent image on the photosensitive drum 21; and 24 (**24*a*–24*d*) a developer which can freely separated from or come into contact with a developing position opposed to the photosensitive drum 21 (24*a* for black, 24*b* for yellow, 24*c* for magenta, and 24*d*** for cyan).

Reference numeral 25 denotes an intermediate transfer belt looped over plural, e.g. four rolls (29–32) to rotate in a direction of an arrow B. Reference numeral 26 denotes a primary transfer device (e.g. corona charger, conductive or semi-conductive roll or conductive or semi-conductive brush) for primary-transferring each of color toner images T on the photosensitive drum 21. Reference numeral 27 denotes a drum cleaner for cleaning residual toners on the photosensitive drum 21. Reference numeral 28 denotes an erase lamp for finally making the potential on the photosensitive drum 21 zero.

Reference numeral 33 denotes a secondary transfer device for secondary-transferring the toner image on the intermediate transfer belt 25 onto a transfer sheet of paper 35. As shown in FIG. 5, the second transfer device is a transfer roll arranged on the side of image forming of the intermediate transfer belt 25 and rotating in contact with the intermediate transfer belt 25 during the secondary transfer. The transfer roll 33 is opposite to a roll 31 arranged on the back of the intermediate transfer belt 25. With the roll 31 as an opposite electrode, during the secondary transfer, a voltage with a polarity opposite to the charging polarity of toners is applied to the transfer roll 33.

Particularly, in accordance with this embodiment, in forming the color image, the transfer roll 33 is separate from the intermediate transfer belt 25 until the toner image with a final color is primary-transferred to the intermediate transfer belt 25. After the toner image with the final color is primarily transferred, it is brought into contact with the intermediate belt 25 at any timing until the tip of the toner image on the intermediate transfer belt 25 reaches a secondary transfer area.

Reference 34 denotes a transfer paper supply tray for supplying a transfer sheet of paper 35 having a prescribed size. Reference numeral 36 denotes a feed roll for feeding out the transfer sheet 35 to the secondary transfer area at a prescribed timing. Reference numeral 37 denotes a transfer guide roll for transfer-guiding the transfer sheet 35 fed out from the feed roll 36 to the secondary transfer area. Reference numeral 39 denotes a peel-away piece for peeling away the transfer sheet 35 applied on the intermediate transfer belt 25 during the secondary transfer. Reference numeral 40 denotes a belt cleaner for peeling away and removing residual toners remaining on the intermediate transfer belt 25. Reference numeral 41 denotes a carrying belt for carrying the transfer sheet 35 subjected to the secondary transfer to a fixing area. Reference numeral 42 denotes a fixing device for fixing the non-fixed toner image on the transfer sheet 35.

In this embodiment, the peeling-away piece 39 and the belt cleaner 40 are arranged separatably from the intermediate transfer belt 25. In forming the color image, these components are separate from the intermediate transfer belt 25 until the toner image of the final color is primary-transferred to the intermediate transfer belt 25.

In this embodiment, the intermediate transfer belt 25 is a long belt member with both ends joined at a seam and made of resin (e.g. acryl, vinyl chloride, polycarbonate and polyimide) or several kinds of rubber containing a suitable quantity of antistatic agent such as carbon black. The belt 25 has a thickness of 0.1 mm and volume resistivity of $10^6$–$10^{14}$ Ω·cm. It is of course that the intermediate transfer belt 25 may not have the seam.

An explanation will be given of the rolls 29 to 32 for looping the intermediate transfer belt 25.

Reference numeral 29 denotes a drive transmission roll which hangs the intermediate transfer belt 25 with an acute angle and has a wide contact area with the intermediate transfer belt 25. The drive transmission roll 29 is made of an extrusion member of aluminum with polyurethane applied thereon. Reference numerals 30 to 32 denote subordinate rolls, respectively. Particularly, the roll 31 also serves as a back-up roll for the transfer roll 33.

In this embodiment, the back-up roll 31 is a conductive roll connected to earth whose surface is coated with a semiconductive thin layer film. Generally, as the conductive roll, a rubber roll containing conductive carbon or a metallic roll is used. In this embodiment, a roll composed of a metallic roll and rubber foam wound thereon and having a hardness of 62 degree in terms of aska C is used.

On the other hand, the thin layer film may be any material such as PVDF, polyester film, PFA and acryl containing a suitable amount of carbon black and having controlled resistance of volume resistivity of $10^8$ Ω·cm or more. When the thin film layer is thinner, the conductive roll easily approaches the transfer roll 33 so that even with a lower voltage applied to the transfer roll 33, a sufficient transfer roll can be obtained, but possibility of occurrence of pin holes and instability of production is increased. In addition, the thin layer film having higher permittivity provides the same effect as that of a thin layer. Taking these facts into consideration, in this embodiment, PVDF having a thickness of 10 μm–100 μm and permittivity of 8 is used. Additionally, in this embodiment, the reason why the volume resistivity of the thin layer film is set for $10^8$ Ω·cm or more is as follows.

In a field of the apparatus to which the present invention belongs, in order to assure safety against touching of a human body, prevent an accident such as ignition due to paper jam and further prevent accidents of damaging or ignition of the intermediate transfer belt due to concentration of a current into a damage or hole generated therein, the current capacity of a power source is limited to several mA or less. If an excess current flows because of e.g. direct touching of the transfer roll 33 with the intermediate transfer belt 35, in order to prevent continuous flow of the excess current, the power supply voltage is designed to drop by the action of a current limiter. Therefore, such a voltage drop gives rise to poor transfer and damage of the intermediate transfer belt.

Meanwhile, if the excess current when transfer sheet 35 is not located is limited to the value of 100 μA or less for a unit length, the current limiter can operate to prevent the power supply voltage from abruptly dropping. In addition, the transfer voltage in this embodiment is about 1000 V. Taking these facts into consideration, it is necessary to set the volume resistance from the contact position between the back-up roll 31 and the intermediate transfer belt 25 to the earth position of the conductive roll for $10^7$Ω or more for unit length (1 cm). For this reason, in this embodiment, for safety, the volume resistivity is set for $10^8$ Ω·cm or more.

By using such a back-up roll 31, where the transfer paper 35 has a small size, even if the transfer roll 33 and the back-up roll 31 are brought into contact with each other through the intermediate transfer belt 25 at the area other than the area corresponding to the transfer sheet 35, no excess current flows because the back-up roll 31 is coated with the thin layer film having a volume thickness of $10^8$ Ω·cm or more. Thus, the intermediate transfer belt can be made free from being damaged owing to the excess current.

Figure 6:
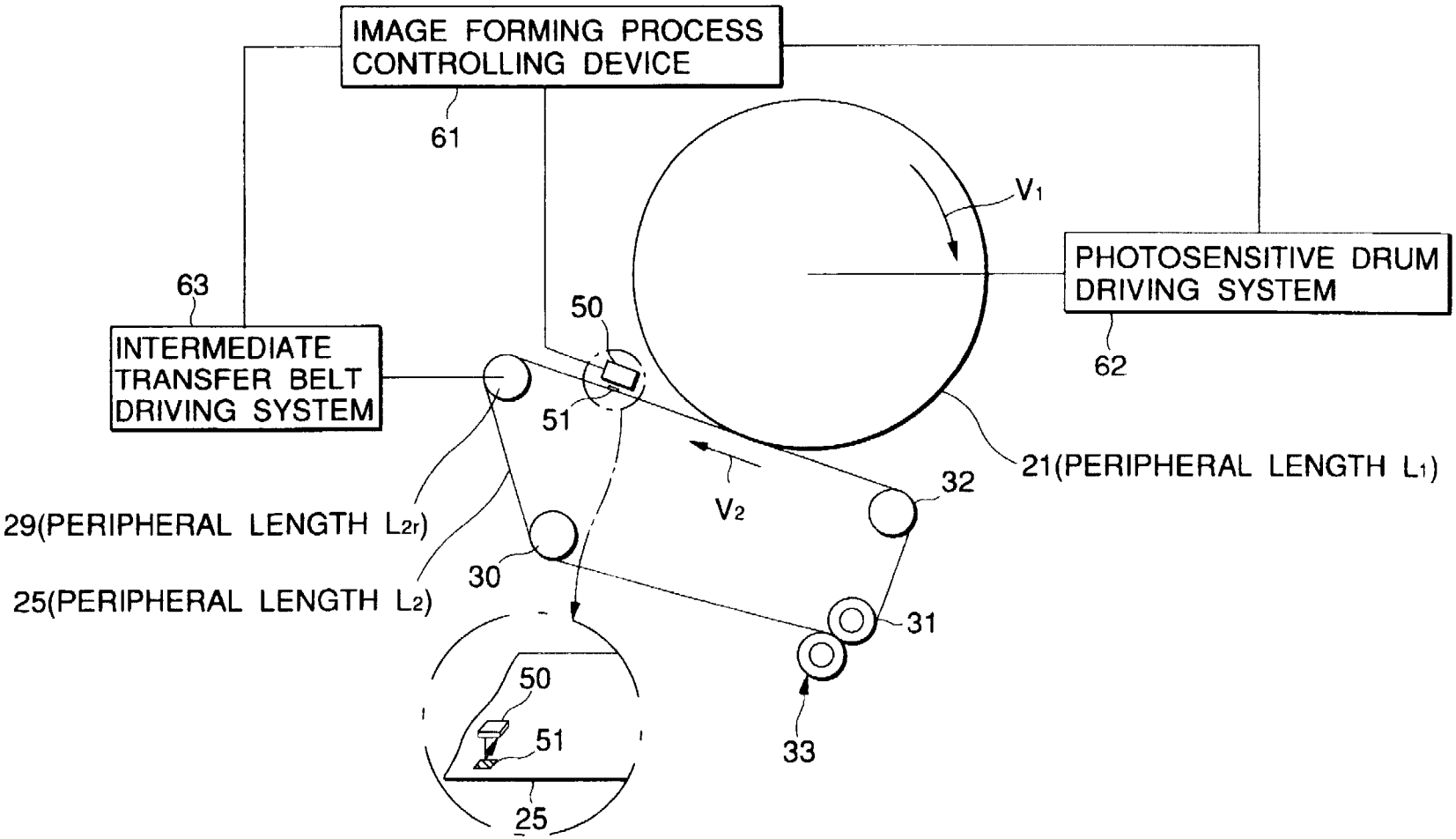
FIG. 6 is a view showing the drive control system for a photosensitive drum and an intermediate transfer drum of the image forming aparatus according to the present invention.

Further, in this embodiment, as seen from FIGS. 5 and 6, a mark 51 having a different reflection coefficient from that of the surface of the intermediate transfer belt 25 is formed on the one side of the width direction of the intermediate transfer belt 25. A mark detecting sensor 50, which is a reflection-type optical sensor, is designed to detect the position of the mark 51 by the light reflected therefrom. The mark may be a hole. In this case, a transmission type optical sensor may be used as the mark detecting sensor 50.

The output from the mark detecting sensor 50, as best seen from FIG. 6, is taken into the an image forming control device 61. The image forming control device 61 serves to determine the timings of image forming for each color in accordance with the detected position of the mark 51 to send a predetermined control signal to a photosensitive drum driving system 62, and the intermediate transfer belt drive system and also a predetermined operating control signal to each process device.

Figure 7A:
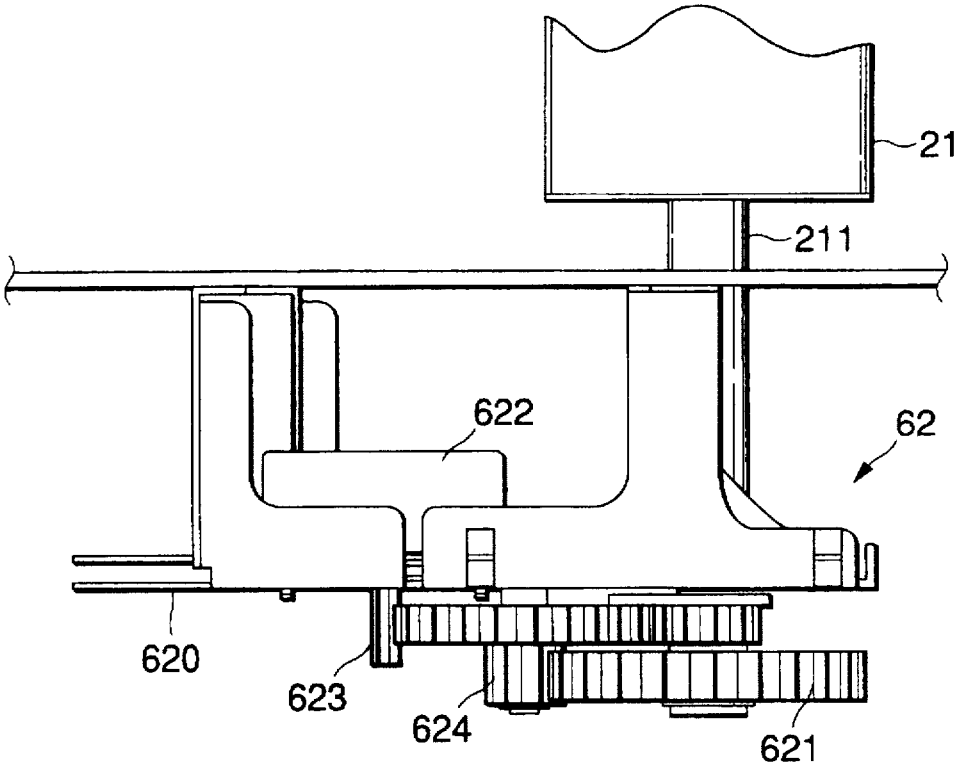
FIG. 7A is a plan view of the photosensitive drum drive system, and FIG. 7B side view of thereof.
Figure 7B:
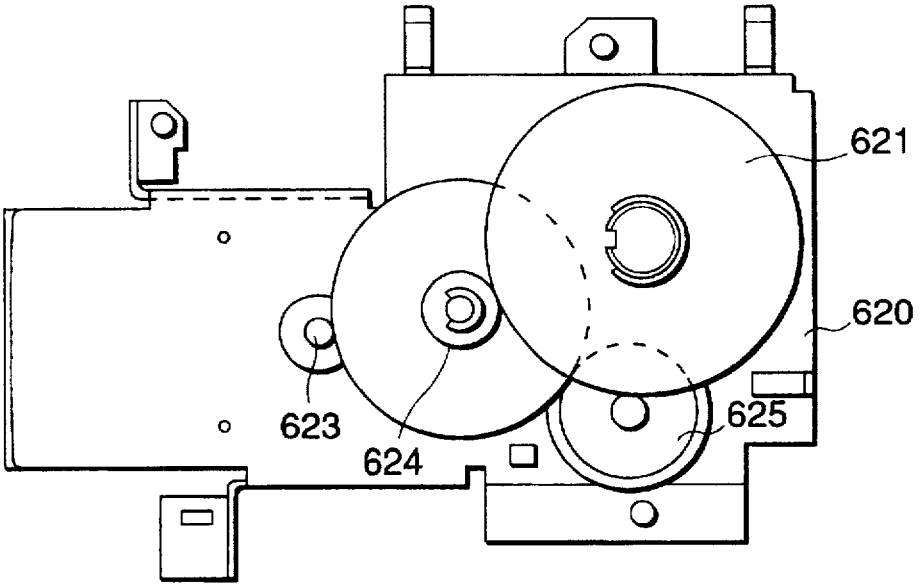

In this embodiment, the photosensitive drum system 62, as shown in FIGS. 7A and 7B, is designed so that a driving gear 621 (Z(number of teeth)=128) is coupled with a drive shaft 211 of the photosensitive drum 21, a drum driving motor 622 is attached to a frame 620, and a motor gear 623 (Z=9) formed on the shaft of the drum driving motor 622 is toothed with the above driving gear 621 through a two-stage idler gear 624 (Z=108/32). Incidentally, reference numeral 625 denotes a reverse rotation clutching gear (Z=54).

Figure 8A:
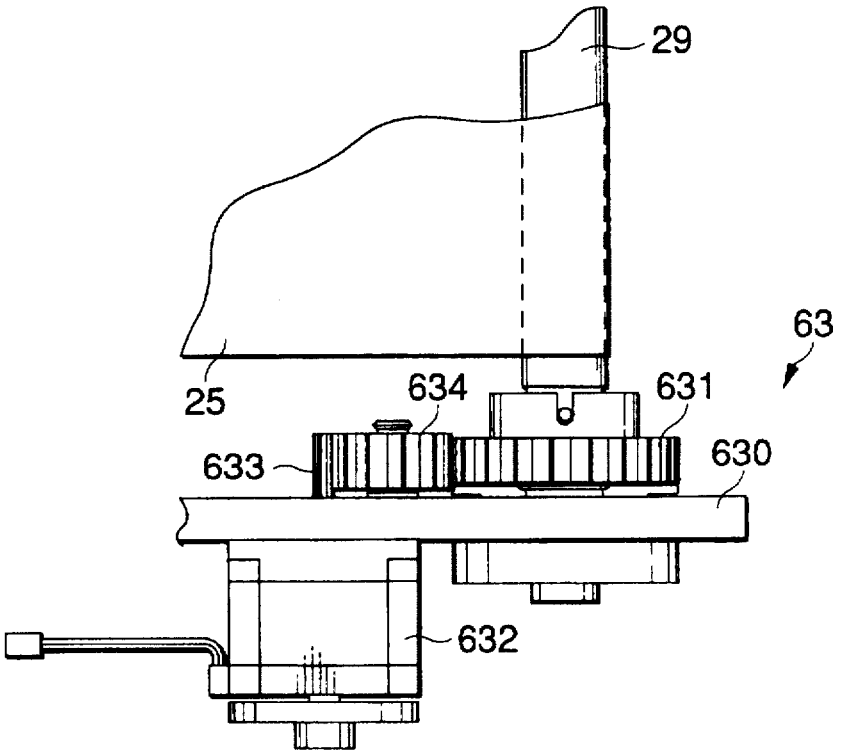
FIG. 8A is a plan view of the intermediate transfer belt system.
Figure 8B:
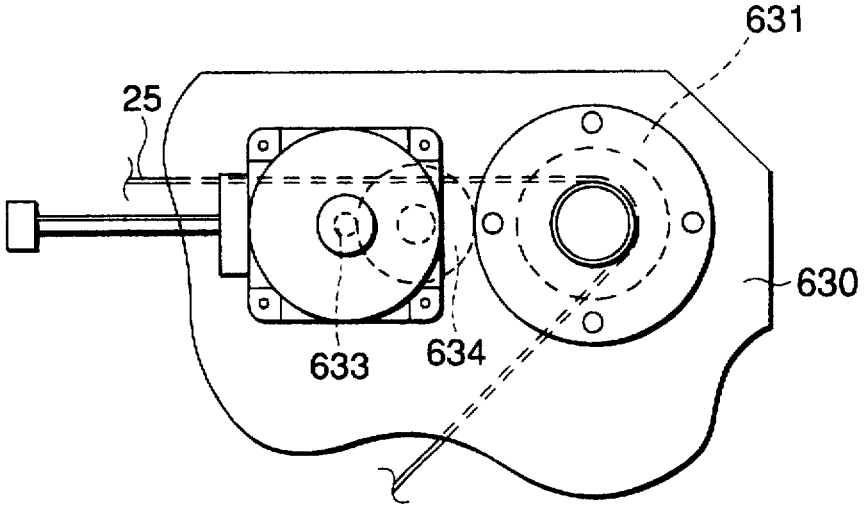
FIG. 8B is a side view thereof.

On the other hand, the intermediate transfer belt system 63 as shown in FIGS. 8A and 8B, is designed so that a driving gear 631 (Z(number of teeth)=96) is coupled with the drive transmission shaft of the intermediate transfer belt 25, a belt driving motor 632 is attached to a frame 630, and a motor gear 633 (Z=8) formed on the shaft of the belt driving motor 632 is toothed with the above driving gear 631 through an idler gear 634 (Z=48). Incidentally, reference numeral 625 denotes a reverse rotation clutching gear (Z=54).

In this embodiment, the intermediate transfer belt 25 having a thickness of 0.1 mm is driven by the drive transmission roll 29 having a diameter of 20.937 mm at a belt speed v2 (v2=159.52 mm/s).

Since the intermediate transfer belt 25 has a peripheral length L2 of 526. 2 mm, when the drive transmission roll 29 rotates eight turns, the intermediate transfer belt 25 rotates one turn. Since the photosensitive drum 21 has a diameter of 168 mm (peripheral length L1: 527. 52 mm), when the intermediate transfer belt 25 rotates one turn, the photosensitive drum 21 also rotates one turn.

In this embodiment, the surface speed v1 of the photosensitive drum 21 is 160.00 mm/s. Namely, the intermediate transfer belt 25 is driven at a higher speed by 0.3% than the photosensitive drum 21.

An detailed explanation will be given of the image forming process of the color image forming device according to this embodiment. With rotation of the photosensitive drum 21 in a direction of arrow A, an electrostatic latent image based on image information is formed on the surface of photosensitive drum 21 by a well known electrophotographic process. After the photosensitive drum 21 is charged to a predetermined dark potential by the charger 22, it is subjected to light exposure according an image signal by an optical beam emitted from the laser exposure device 23.

The electrostatic latent image formed on the photosensitive drum 21 is developed by one of the developers **24*a* to 24*d* to form a toner image T. Therefore, if the electrostatic latent image written on the photosensitive drum 21 corresponds to image information of yellow, it is developed by the developer 24*b* containing toners of yellow (Y) so that the yellow toner image is formed on the photosensitive drum 21**.

The toner image T formed on the photosensitive drum 21 is transferred by electrostatic attraction from the photosensitive transfer drum 21 to the intermediate transfer belt 25 at a primary transfer position where the photosensitive drum 21 is in contact with the intermediate transfer belt 25. The electrostatic attraction is performed in a manner of applying a DC current having a polarity opposite to the charging polarity of toners to the primary transfer apparatus 26 arranged on the back of the intermediate transfer belt 25.

On the other hand, the toners remaining on the photosensitive drum 21 after the primary transfer are cleaned by the drum cleaner 27. Thereafter, the erase lamp 28 projects light to the photosensitive drum 21 so that the surface potential of the photosensitive drum 21 becomes ± 0 V for preparation of the next charging step.

Where formation of a monochromatic image is intended, the toner image T primary-transferred to the intermediate transfer belt 25 is immediately secondary-transferred to the transfer sheet 35. On the other hand, where formation of a color image with plural toner images superposed is intended, the formation of the toner image on the photosensitive drum 21 and the step of primary transfer of the toner image are repeated by the number of times corresponding to the number of colors. For example, where a full color image with four toner images superposed is to be formed, the toner images T of black, yellow, magenta and cyan are formed for each turn of rotation on the photosensitive drum 21. These toner images T are successively primary-transferred onto the intermediate transfer belt 25. On the other hand, the intermediate transfer belt 25, while it holds the toner image T of black first primary-transferred, rotates at the same period as that of the photosensitive drum 21. On the intermediate transfer belt 25, the toner images T of yellow, magenta and cyan are superposition-transferred to the toner image T of black for each turn of rotation.

In such a first primary transfer step, as shown in FIG. 6, the peripheral speed v1 of the photosensitive drum 21 is 160.00 mm/s whereas the peripheral speed v2 of the intermediate transfer belt 25 is 159. 52 mm/s, the toner images for the respective colors are multiply-transferred in slightly shifted states. Thus, the phenomenon of fall-out of the toner image on the uppermost layer did not occur.

Since the peripheral length L2 of the intermediate transfer belt 25 is integer-times (eight times in this embodiment) as long as that L2r of the drive transmission roll 29, the eccentric error of the drive transmission roll 29 appears at a prescribed area of the surface of the intermediate transfer belt 25. Further, since when the intermediate transfer belt 25 rotates one turn, the photosensitive drum 21 rotates one turn, even if the photosensitive drum 21 has a varying diameter due to its swing and the surface speed of the photosensitive drum 21 varies owing to the eccentric error of the photosensitive drum 21, the area of the photosensitive drum 21 where the speed varies appears periodically at a prescribed area of the intermediate transfer belt 25.

Figure 9:
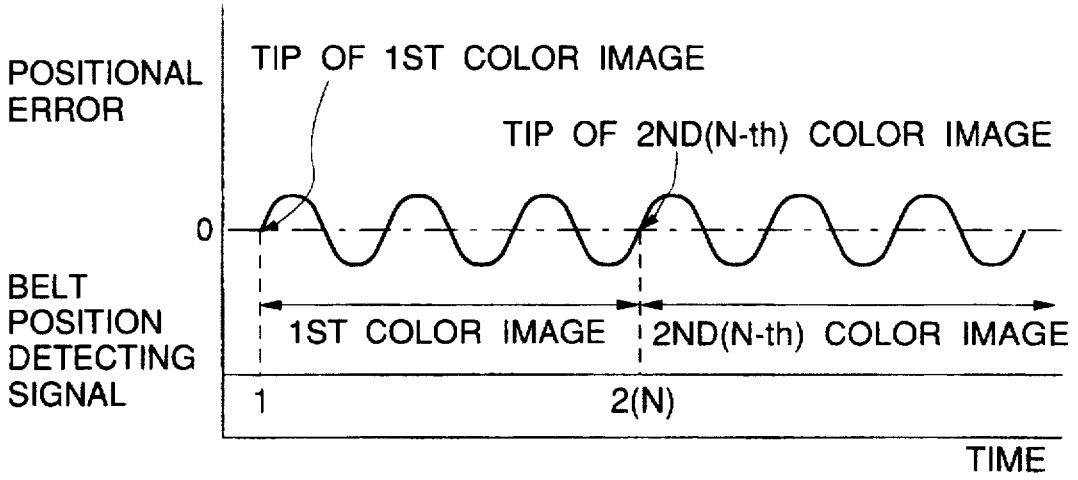
FIG. 9 is a view showing the positional error between the first color image and the second (N-th) color image on the intermediate tranfer belt according to the first embodiment.

Thus, in this embodiment, as shown in FIG. 9, the start position of writing the first image on the intermediate transfer belt 25 completely coincides with that of writing the second (N: 2, 3, 4) color image, no positional displacement occurs. In addition, since the predetermined area of the photosensitive drum 21 corresponds to that of the intermediate transfer belt 25, inconsistencies in charging or application (painting) of the photosensitive drum 21 do not vary for each of the color components.

Therefore, in this embodiment, the toner image for each color on the intermediate transfer belt 25 is a very good image free from the color variation due to the positional displacement and the color inconsistency due to the inconsistencies in charging or application of the photosensitive drum 21.

Figure 10:
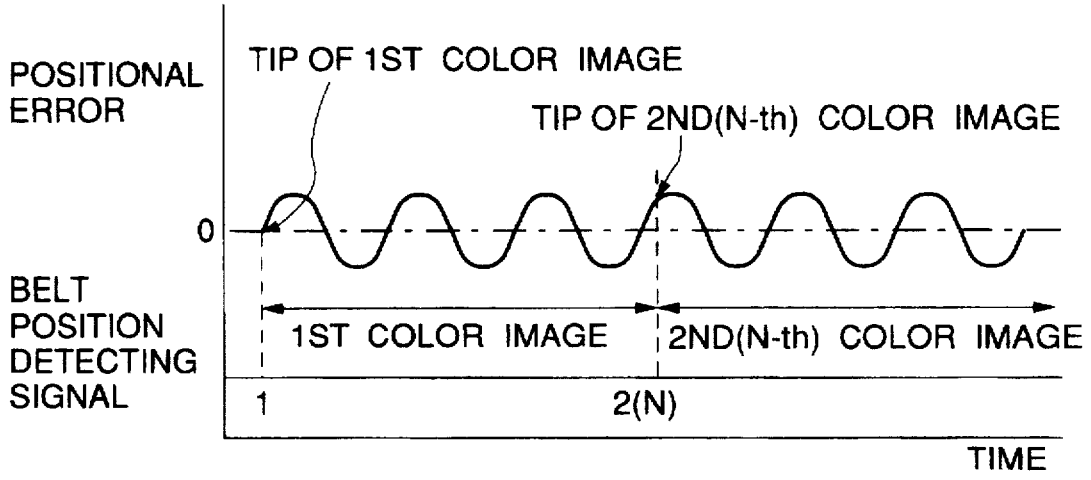
FIG. 10 is a view showing the positional error between the first color image and the second (N-th) color image on the intermediate transfer belt according to a comparative example.

In comparison to the above manner, where the peripheral length L2 of the intermediate transfer belt 25 is not intertimes as long as the drive transmission roll 29, as shown in FIG. 10, the eccentric error of the drive transmission roll 29 does not periodically appear at a prescribed area of the surface of the intermediate transfer belt 25. Therefore, the starting position of writing the first color on the intermediate transfer belt 25 does not coincide with that of writing the second (N: 2, 3, 4) color image.

In this comparative manner, further where when the intermediate transfer belt 25 rotates one turn, the photosensitive drum 21 does not rotate integer-times turns, if the photosensitive drum 21 has a varying diameter due to its swing and the surface speed of the photosensitive drum 21 varies owing to the eccentric error of the photosensitive drum 21, the area of the photosensitive drum 21 where the speed varies appears non-periodical areas of the intermediate transfer belt 25. The first color image does not coincide with the second (N-th) color image and the inconsistencies in charging or application of the photosensitive drum 21 varies for each color component.

Figure 11:
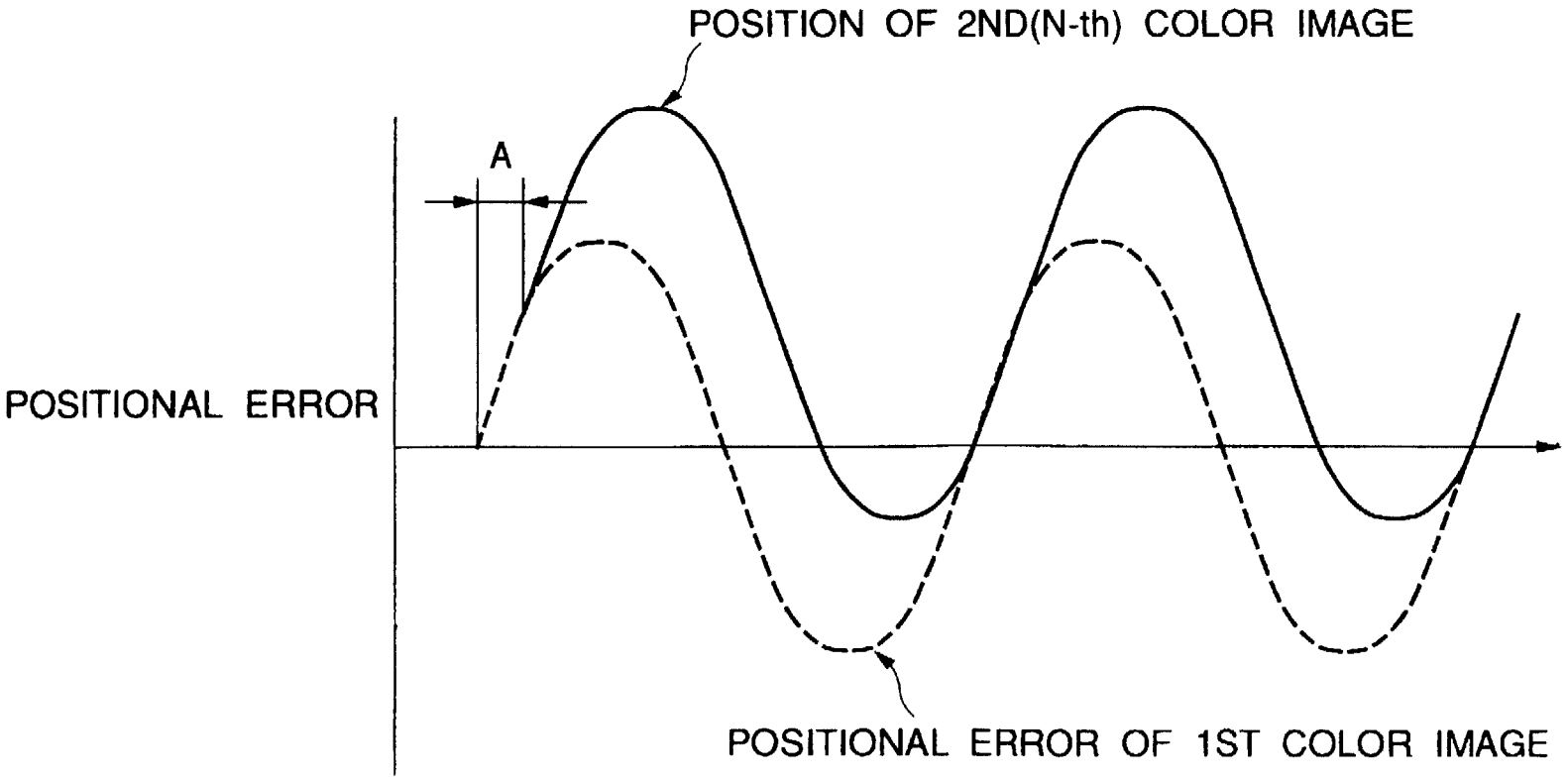
FIG. 11 is a view showing, in superposition, the positional error between the first color image and the second (N-th) color image on the intermediate transfer belt according to a comparative example.

Specifically, as shown in FIG. 11, when the toner images of the first color and second (N-th) color are superposed on the intermediate transfer belt 25, the positional error among the toner images for the respective colors occurs as indicated by A. Thus, the respective color toner images on the intermediate transfer belt 25 provide the color displacement due to the positional displacement and the color inconsistency due to the inconsistency of charging or application of the photosensitive drum 21.

By the rotation of the intermediate transfer belt 25, the toner image T primary-transferred onto the intermediate transfer belt 25 is carried to the secondary transfer position facing the carrying path of the transfer sheet 35 by the rotation of the intermediate transfer belt 25.

At the secondary transfer position, the transfer roll 33 which is the second transfer device, is in contact with the intermediate transfer belt 25. The transfer sheet 35 fed out from the tray 34 at a prescribed time by the feed roller 36 is sandwiched in between the transfer roll 33 and the intermediate transfer belt 25. On the back of the intermediate transfer belt 25 at the second transfer position, the conductive roll 31 is arranged which serves as an opposite electrode to the transfer roll 33. When a voltage with a polarity reverse to the charging polarity of toners is applied to the transfer roll 33, the toner image T carried on the intermediate transfer belt 25 is transferred by electrostatic attraction on the transfer sheet 35 at the secondary transfer position.

The transfer sheet 35 with the toner image T transferred is peeled away from the intermediate transfer belt 25 by the peel-away piece 39 and sent into the fixing device 42 which serves to fix the toner image. On the other hand, the residual toners on the intermediate transfer belt 25 which have completed the secondary transfer of toners are removed by the belt cleaner 40.

Further, it is of course that several modifications of this embodiment may be designed.

For example, in this embodiment, the roll 29 of the rolls 29–32 of the intermediate transfer belt 25 was used as a drive transmission roll. But by using the roll 32 opposite to the belt cleaner 40 as a drive transmission roll, even if there is a change in the load for the intermediate transfer belt 25 due to the retract operation of the belt cleaner 40, the influence from the change in the load can be suppressed.

In this embodiment, although the drum driving motor 622 and belt driving motor 632 were individually provided, they may be constituted as a single motor.

In this embodiment, the image forming process controlling device 61 drives the intermediate transfer belt 25 at a constant peripheral speed v2. But, after the toner image of the final color is primary-transferred from the photosensitive drum 21 to the intermediate transfer belt 25, the device 61 may change the mode of the driving speed of the intermediate transfer belt 25 into a low seed mode to decrease the passing speed of the transfer sheet over the fixing device 42, thus enhancing the fixing property of the color toner image.

In this case, in the relationship between the primary transfer position and the secondary transfer position, where the tip of the toner image on the intermediate transfer belt 25 when the primary transfer of the toner image of the final color is completed passes the secondary transfer position (e.g. the image has a maximum size), after the intermediate transfer belt 25 is further idled one turn, before the tip of the toner image on the intermediate transfer belt 25 reaches the secondary transfer position, the drive mode of the intermediate transfer belt 25 may be switched into a low speed mode.

(Embodiment 2)

Figure 12:
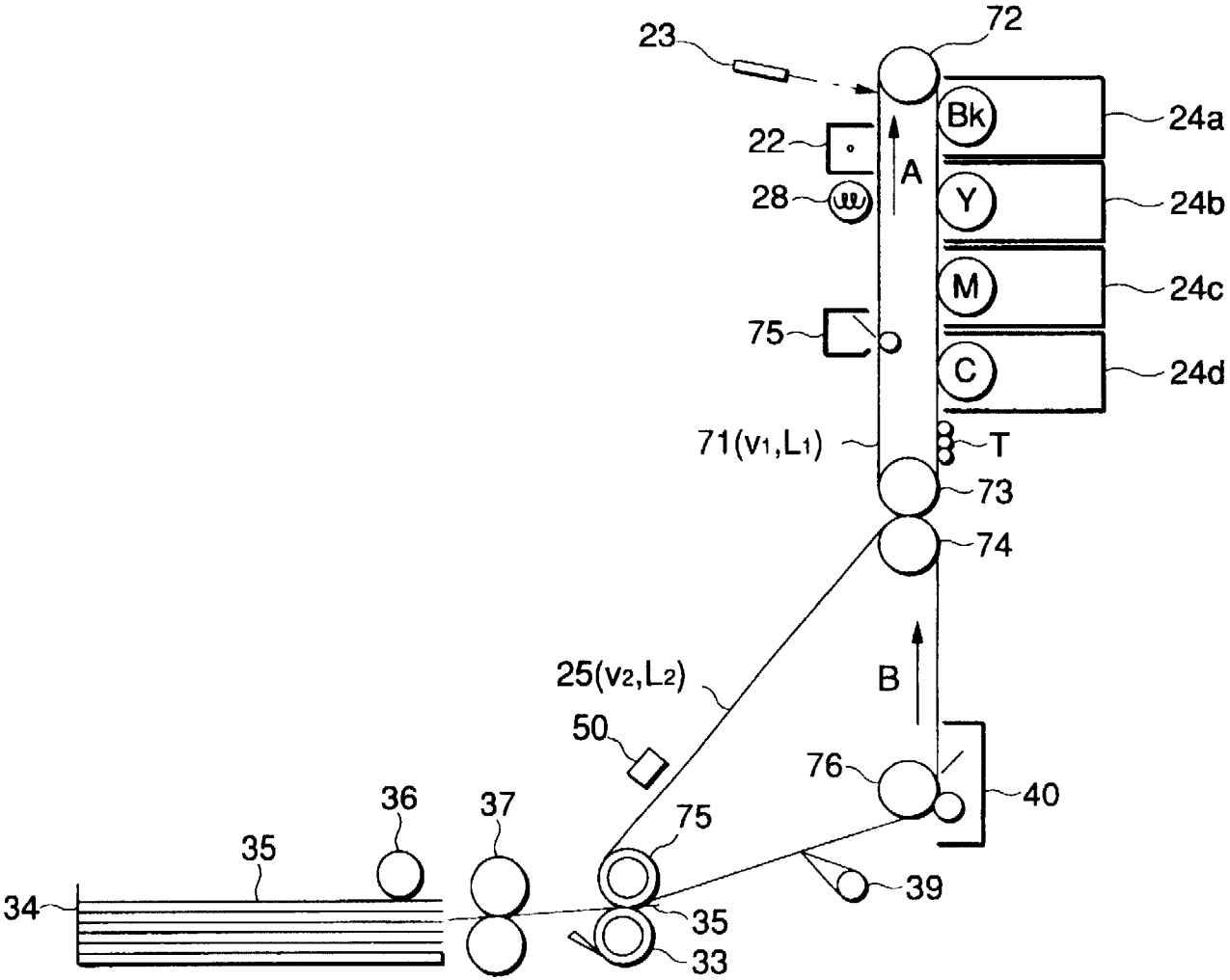
FIG. 12 is a view showing the image forming apparatus according to the second embodiment of the present invention.

FIG. 12 shows the second embodiment of the color image forming using the photosensitive belt and intermediate transfer belt to which the present invention is applied. In the explanation of the second embodiment, like reference numerals refer to like components in the explanation of the first embodiment.

In FIG. 12, reference numeral 71 denotes a photosensitive belt composed of a base layer of e.g. resin or several kinds of rubber and an overlying conductive (metal) or semiconductive current-flowing layer coated with a photosensitive layer. The photosensitive belt 71 is looped over a pair of rolls 72 and 73. In this embodiment, the roll 72 is used as a drive transmission roll.

Around the photosensitive belt 71, as in the first embodiment, there are arranged the charger 22, laser exposure device 23, developers 24*a* to 24*d*, primary transfer device 74 of an electrostatic transfer roll, belt cleaner 75 for removing the residual toners on the photosensitive belt 71 and erase lamp 28 for removing the residual charges on the photosensitive belt 71.

Further, except that the looping structure of the intermediate transfer belt 25 is slightly different from that of the first embodiment, in this embodiment, the intermediate transfer belt 2 and the devices around it are the same as in the first embodiment.

A brief explanation will be given of the looping structure of the intermediate transfer belt 25. In this embodiment, the intermediate transfer belt 25 is looped over the rolls 74 to 76. The roll 74 is a subordinate roll for belt conveying serving as an electrostatic transfer roll as described above. The roll 75 is a belt conveying subordinate roll serving as a back-up roll of the transfer roll 33 which is the secondary transfer device. The roll opposite to the belt cleaner 40 is used as the drive transmission roll.

In this embodiment, the peripheral speed v1 of the photosensitive belt 71 and the peripheral speed v2 of the intermediate transfer belt 25 are equal to those in the first embodiment. In addition, when the photosensitive belt 71 rotates one turn, the intermediate transfer belt 25 also rotates one turn. In this embodiment, the peripheral length of the photosensitive drum 71 is integer-times (e.g. eight times) as long as that of the drive transmission roll 72, and the peripheral length L2 of the intermediate transfer belt 71 is integer-times as long as the peripheral length of the drive transmission roll 76. The ratio of integer of the photosensitive drum 71 and intermediate transfer drum 25 to the drive transmission rolls 72 and 76 may not necessarily equal.

An explanation will be given of the image forming process of the color image forming according to this embodiment.

The image forming process according to this embodiment is substantially the same as in the first embodiment. The photosensitive belt 71 will be subjected to charging, light exposure, development and primary transfer. The toners remaining on the photosensitive belt 71 after the primary transfer are removed away by the belt cleaner 75.

The process after the primary transfer is the same as the first embodiment.

In such an image forming process, the peripheral speed v1 of the photosensitive drum 71 is 160.00 mm/s whereas the peripheral speed v2 of the intermediate transfer belt 25 is 159.52 mm/s, the toner images for the respective colors are multiply-transferred in slightly shifted states. Thus, the phenomenon of fall-out of the toner image on the uppermost layer did not occur.

Since the peripheral length L1 of the photosensitive belt 71 and the peripheral length L2 of the intermediate transfer belt 25 are integer-times as long as those of the drive transmission rolls 72 and 76, the eccentric error of each of the drive transmission rolls 72 and 76 periodically appears at a prescribed area of the surface of each of the photosensitive belt 71 and the intermediate transfer belt 25. Further, since when the intermediate transfer belt 25 rotates one turn, the photosensitive belt 71 rotates one turn, even if the surface speed of the photosensitive belt 71 is varied due to its swing and the surface speed of the photosensitive drum 21 varies owing to the eccentric error of the photosensitive drum 21, the speed varying area of the photosensitive belt 71 periodically appears at a prescribed area of the intermediate transfer belt 25.

Thus, also in this embodiment, as shown in FIG. 9, the start position of writing the first image on the intermediate transfer belt 25 completely coincides with that of writing the second (N: 2, 3, 4) color image, no positional displacement occurs. In addition, since the predetermined area of the photosensitive belt 71 corresponds to that of the intermediate transfer belt 25, inconsistencies in charging or application of the photosensitive belt 71 do not vary for each of the color components.

Therefore, in this embodiment also, the toner image for each color on the intermediate transfer belt 25 is a very good image free from the color displacement due to the positional displacement and the color inconsistency due to the inconsistency of charging or application of the photosensitive belt 71.

As described above, in accordance with the present invention, in an image forming apparatus provided with a rotary intermediate transfer medium arranged in pressure-contact with an image carrier, since the image carrier and intermediate transfer medium have different peripheral speeds so that the time required for the former to rotate one turn is integer-times as long as that for the latter to rotate one turn, the fall-out phenomenon of toners on the uppermost layer can be efficiently prevented. In addition, it is possible to prevent effectively the color displacement due to positional displacement of toners for each color on the intermediate transfer medium 25 and color inconsistency due to the inconsistency of charging or application of the image carrier. Thus, an improved image can be obtained.

Particularly, in a structure in which at least one of the image carrier and the intermediate transfer medium is a belt-shape rotary body, since the peripheral length of the belt is adjusted to be integer-times as long as that of the drive transmission roll, the eccentric error of the drive transmission roll can be located periodically at a prescribed area of the belt-shape rotary body. This surely avoids the positional displacement of the toner image for each color on the belt-shape rotator due to the eccentric error of the drive transmission roll.

Further, in accordance with the present invention, in order to avoid the displacement and inconsistency of color, the accuracy of size and mounting of the image carrier and intermediate transfer medium or the drive transmission roll of the belt-shape rotary body may not be so high. Since a complicate control system may not be necessary to align the toner images of the respective colors, the apparatus structure can be simplified.

In the present invention, by setting the contact area of the drive transmission roll with the belt-shape rotary body to be large, or otherwise by providing the drive transmission roll at an area where a change in the load of the belt-shape rotary body is large, the carrying stability of the belt-shape rotary body can be assured.

In the present invention, by changing the shifting speed of the intermediate transfer medium at a prescribed timing, various effects such as enhancement of the fixing property of the color toner images can be attained.

Moreover, in the present invention, by making the peripheral speeds of the image carrier and intermediate transfer medium different, the fall-out phenomenon of the toner image on the uppermost layer can be effectively avoided, thus maintaining the quality of the color image.

What is claimed is:

1. An image forming method using an image forming apparatus comprising:

a rotary image carrier, and a rotary intermediate transfer medium arranged in pressure-contact with said image carrier, wherein at least one of said image carrier and said intermediate transfer medium is a belt-shape rotary body which is looped over a group of rolls and can circulate with at least one of said rolls as a drive transmission roll, and the peripheral length of said belt-shape rotary body is m (m: integer)-times as long as the peripheral length of said drive transmission roll, comprising the steps of:

a toner image forming step of rotating said image carrier at a constant peripheral speed to form a toner image successively for each color component on said image carrier;

a toner image intermediate transfer step of rotating said intermediate transfer medium at a constant peripheral speed different from the constant peripheral speed of said image carrier, on condition that one revolution time of said intermediate transfer medium is n (n: integer or 1/integer)-times as long as one revolution time of said image carrier, to transfer the toner image for each color component carried on said image carrier; and a toner image final transfer step of collectively transferring the toner image for each color transferred on said intermediate transfer medium onto a recording medium.

2. An image forming apparatus comprising:

a rotary image carrier, an intermediate transfer medium in pressure-contact with said image carrier, a multi-color toner image forming means for successively forming a toner image for each color by a predetermined image forming process on said image carrier, a primary transfer means for successively transferring the toner image for each color carried on said image carrier to said intermediate transfer medium, and a secondary transfer means for collectively transferring the toner image for each color multiply transferred on said intermediate transfer medium onto a recording medium, at least one of said image carrier and said intermediate transfer medium being a belt-shape rotary body which is looped over a group of rolls and can circulate at least one of said rolls as a drive transmission roll, an image carrier driving means for driving said image carrier at a constant peripheral speed; and an intermediate transfer medium driving means for rotatively driving said intermediate transfer medium at a constant peripheral speed different from the constant peripheral speed of said image carrier so as to satisfy the condition that one revolution time of said intermediate transfer medium is n (n: integer or 1/integer)-times as long as one revolution time of said image carrier.

3. The image forming apparatus of claim 2, wherein said drive transmission roll has a larger contact area with said belt-shape rotary body than the contact area of other rolls in the group of rolls.

4. The image forming apparatus of claim 2, wherein said drive transmission roll of said belt shape rotary body is located at a position where there is a large change in the load for said belt-shape rotary body.

5. The image forming apparatus of claim 2, wherein after the primary transfer step of transferring the toner image of a final color from said image carrier to said intermediate transfer medium has been completed, the peripheral speed of said intermediate transfer medium is varied.

6. An image forming apparatus comprising:

a rotary image carrier, an intermediate transfer medium in pressure-contact with said image carrier, a multi-color toner image forming means for successively forming a toner image for each color by a predetermined image forming process on said image carrier, a primary transfer means for successively transferring the toner image for each color carried on said image carrier to said intermediate transfer medium, and a secondary transfer means for collectively transferring the toner image for each color multiply transferred on said intermediate transfer medium, one of said image carrier and said intermediate transfer medium being a drum-shape rotary body and the other being a belt-shape rotary body which is looped over a group of rolls and can circulate at least one of said rolls as a drive transmission roll, an image carrier driving means for driving said image carrier at a constant peripheral speed; and an intermediate transfer medium driving means for driving said intermediate transfer medium at a constant peripheral speed different from the constant peripheral speed of said image carrier, wherein a peripheral length of said belt-shape rotary body is set so as to satisfy the following relationship equation:

$$Lb=m\cdot Lbr \ (m\text{: integer})$$

$$Lb/vb=n\cdot Ld/vd \ (n\text{=integer or 1/integer})$$

where

Lb: peripheral length of said belt-shape rotary body

Lbr: peripheral length of said drive transmission roll

Ld: peripheral length of said drum-shape rotary body vb: peripheral speed of said belt-shape rotary body vd: peripheral speed of said drum shape rotary body.

7. An image forming apparatus comprising:

a rotary image carrier, an intermediate transfer medium in pressure-contact with said image carrier, a multi-color toner image forming means for successively forming a toner image for each color by a predetermined image forming process on said image carrier, a primary transfer means for successively transferring the toner image for each color carried on said image carrier to said intermediate transfer medium, and a secondary transfer means for collectively transferring the toner image for each color multiply transferred on said intermediate transfer medium to a recording medium, both of said image carrier and said intermediate transfer medium being belt-shape rotary bodies each of which is looped over a group of rolls and can circulate with at least one of said rolls as a drive transmission roll, an image carrier driving means for driving said image carrier at a constant peripheral speed; and an intermediate transfer medium driving means for rotatively driving said intermediate transfer medium at a constant peripheral speed different from that of said image carrier, wherein the peripheral length of said belt-shape rotary body of each of said image carrier and said intermediate transfer medium is set so as to satisfy the following relationship equation:

$$Lb1=m1\cdot Lbr1 \ (m1\text{: integer})$$

$$Lb2=m2\cdot Lbr2 \ (m2\text{: integer})$$

$$Lb1/vb1=n\cdot Lb2/vb2 \ (n\text{=integer or 1/integer})$$

where

Lb1: peripheral length of said belt-shape rotary body of said image carrier

Lbr1: peripheral length of said drive transmission roll of said image carrier

Lb2: peripheral length of said belt-shape rotary body of said intermediate transfer medium Lbr2: peripheral length of said drive transmission roll of said intermediate transfer medium vb1: peripheral speed of said belt-shape rotary body (=Vp) of said image carrier vb2: peripheral speed of said belt-shape rotary body (=Vm) of said intermediate transfer medium.

8. An image forming method using an image forming apparatus comprising:

a rotary image carrier, and a rotary intermediate transfer medium arranged in pressure-contact with said image carrier, comprising the steps of:

a toner image forming step of rotating said image carrier at a constant peripheral speed to form a toner image successively for each color component on said image carrier;

a toner image intermediate transfer step of rotating said intermediate transfer medium at a constant peripheral speed different from the constant peripheral speed of said image carrier, on condition that one revolution time of said intermediate transfer medium is n (n: integer or 1/integer)-times as long as one revolution time of said image carrier, to transfer the toner image for each color component carried on said image carrier onto said intermediate transfer medium; and a toner image final transfer step of collectively transferring the toner image for each color transferred on said intermediate transfer medium onto a recording medium.

9. An image forming apparatus comprising:

a rotary image carrier, an intermediate transfer medium in pressure-contact with said image carrier, a multi-color toner image forming means for successively forming a toner image for each color by a predetermined image forming process on said image carrier, a primary transfer means for successively transferring the toner image for each color carried on said image carrier to said intermediate transfer medium, and a secondary transfer means for collectively transferring the toner image for each color multiply transferred on said intermediate transfer medium onto a recording medium, an image carrier driving means for driving said image carrier at a constant peripheral speed; and an intermediate transfer medium driving means for driving said intermediate transfer medium at a constant peripheral speed different from the constant peripheral speed of said image carrier so as to satisfy the condition that one revolution time of said intermediate transfer medium is n (n: integer or 1/integer) -times as long as one revolution time of said image carrier.

* * * * *